United States Patent [19]

Dawdy

[11] 4,056,904

[45] Nov. 8, 1977

[54] WALLBOARD APPLICATION METHOD AND APPARATUS THEREFOR

[75] Inventor: Jack A. Dawdy, Kenmore, N.Y.

[73] Assignee: National Gypsum Company, Buffalo, N.Y.

[21] Appl. No.: 694,539

[22] Filed: June 10, 1976

[51] Int. Cl.[2] ..... E02D 35/00; E04B 2/00

[52] U.S. Cl. ..... 52/127; 52/98; 52/434; 52/746; 52/747

[58] Field of Search ..... 52/98, 99, 506, 509, 52/127, 434, 483, 746, 747; 269/47, 49, 50

[56] References Cited

U.S. PATENT DOCUMENTS

| | | | |
|---|---|---|---|
| 2,107,240 | 2/1938 | Eilertsen | 52/483 |
| 3,229,435 | 1/1966 | Olsen | 52/434 |
| 3,274,680 | 9/1966 | Cruse | 52/741 X |
| 3,300,933 | 1/1967 | Donahue | 52/417 X |
| 3,378,975 | 4/1968 | Hill | 52/509 X |
| 3,588,082 | 6/1971 | Chiffoleau | 52/489 X |
| 3,742,670 | 7/1973 | Byrd, Jr. | 52/410 X |
| 3,925,948 | 12/1975 | Sauer et al. | 52/434 |
| 3,978,626 | 9/1976 | Weinar | 52/746 X |
| 3,987,595 | 10/1976 | Dawdy et al. | 52/363 X |

FOREIGN PATENT DOCUMENTS

| | | | |
|---|---|---|---|
| 691,200 | 5/1953 | United Kingdom | 52/509 |

*Primary Examiner*—Alfred C. Perham
*Attorney, Agent, or Firm*—Robert F. Hause

[57] ABSTRACT

A temporary holding of wallboard against studs with adhesive therebetween, while the adhesive sets, involving an elongate semirigid rod removably affixed at one end to the stud, the other end projecting out from between the edges of two adjacent wallboards, and a retainer plate engaging the flexible rod and pressing the wallboards against the stud, the engagement of the plate with the rod being such that the rod prevents the plate from moving away from the wallboard until removal is desired.

10 Claims, 11 Drawing Figures

WALLBOARD APPLICATION METHOD AND APPARATUS THEREFOR

This invention relates to holding wallboard firmly against a stud until adhesive therebetween has taken a sufficient set, and particularly to a rod and retainer plate which coact in a novel way to hold the retainer plate firmly against the wallboard faces, adjacent a joint.

Predecorated gypsum wallboard is commonly applied to studs or other structural framing members by use of an adhesive, rather than damaging the predecorated face with nails or screws. In adhesive application of wallboard, it is necessary to provide some secondary temporary means for holding the board to the stud until the adhesive dries or sets or in some manner becomes firm.

In accordance with the present invention, an elongate rod is removably affixed to one end to a stud face so that it extends out from between the edges. A retainer plate has a hole or slot through which the rod extends. The hole or slot has means for engaging the rod and preventing the retainer plate from moving away from the stud end when desired, and the plate can thus be pressed against the wallboard and held there by the rod, for as long as desired. After removing the retainer plate, the rod can be removed, also, leaving the wallboard adhered to the studs.

It is an object of the invention to provide an improved method for temporarily holding wallboard to studs while an adhesive sets.

It is a further object to provide a novel combination of elements for temporarily holding wallboard to studs.

These and other objects and advantages of the present invention will be more fully apparent when considered in relation to the preferred embodiments thereof as set forth in the specification and as shown in the drawings in which.

Figures 1, 4:
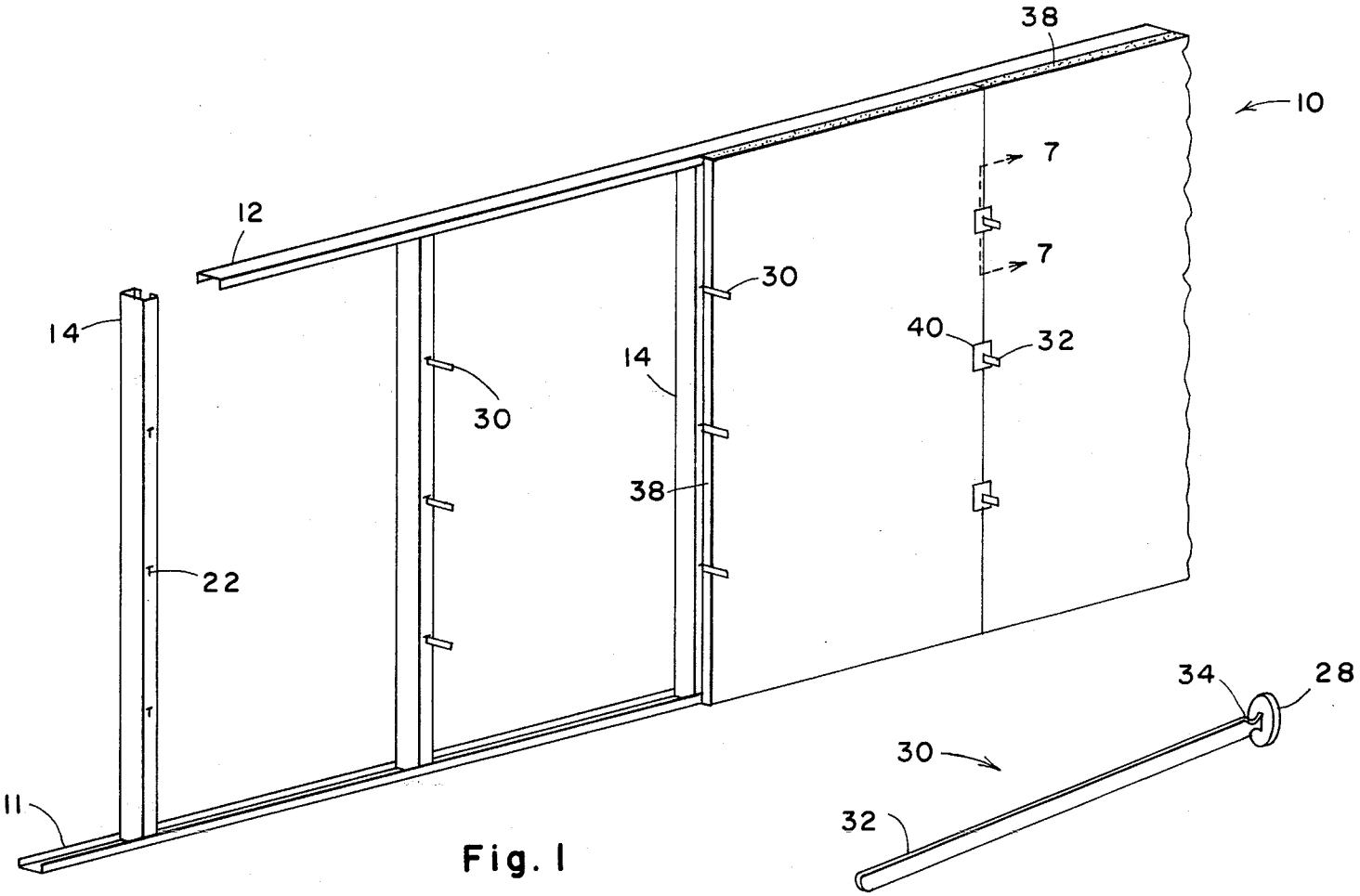
FIG. 1 is an isometric view of a wall in various degrees of completion of construction in accordance with the present invention.
FIG. 4 is an isometric view of a retainer rod, as embodied in the wall of FIG. 1.

Referring to FIG. 1, there is shown a wall 10 which is in various degrees of completion. At the left end of the wall 10, there are shown a floor track 11, a ceiling track 12 and spaced vertical studs 14, 14 disposed within and extending between the floor track 11 and ceiling track 12.

Figure 2:
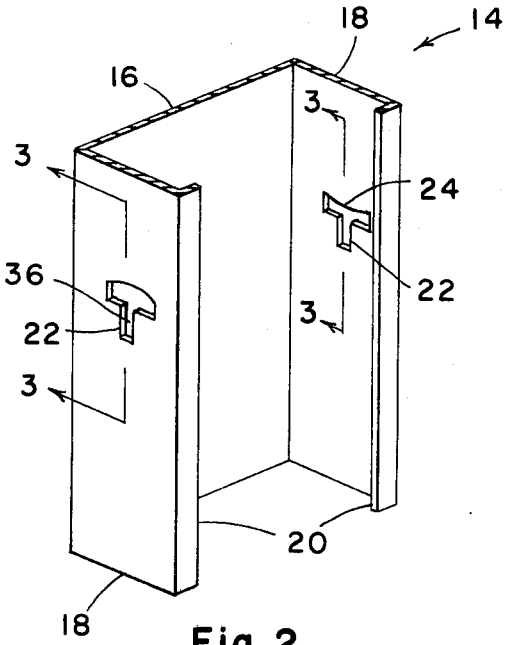
FIG. 2 is an isometric view of one of the studs of the wall of FIG. 1.

The studs 14 are formed of sheet metal with a C-shaped cross section, see FIG. 2, and include a main web 16, a pair of opposed face flanges 18, 18 and a pair of opposed stiffening flanges 20, 20.

Figure 3:
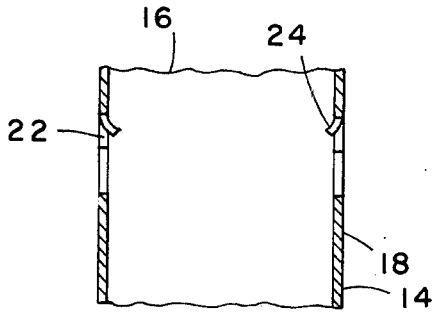
FIG. 3 is a vertical cross section of the stud of FIG. 2 taken along the plane of the line 3—3.

The face flanges 18, 18 have a plurality of T-shaped openings 22, 22 centered laterally at a plurality of spaced apart vertical locations, preferably about every two feet. The sheet metal disposed above each opening 22 is bent slightly out of the general plane of the rest of the face flange 18, forming an inwardly bent top edge 24 as best seen in FIG. 3.

The bent edges above openings 22, 22, permit insertion of the head 28 of a semirigid plastic retainer rod 30, as in FIG. 4. Retainer rod 30 includes, in addition to head 28, an elongate stem 32, which in the embodiment shown is an elongate section of rectangular cross section. Rod 30 is preferably flexible but substantially nonstretchable. The stem 32 is joined to head 28 by a reduced cross section neck 34, designed to provide a controlled breaking location, so that when it is desired to break the stem 32 from the head 28, the break will occur at the neck 34.

The head 28 is designed to fit into a T-shaped opening 22, with the stem extending outwardly through the lower vertical portion 36 of opening 22. A plurality of retainer rods 30, 30 are shown disposed in a plurality of openings 22, 22, in the second and third studs 14, 14 from the left in FIG. 1.

The stems 32, 32 of retainer rods 30, 30 can also be seen extending outwardly from a fourth from left stud (not shown) in FIG. 1, wherein a pair of adjacent, coplanar wallboards 38, 38 are shown disposed against the studs and floor and ceiling tracks, and retainer plates 40, 40 are shown affixed to stems 32, 32 to hold wallboards 38, 38 firmly against the fourth stud.

Figure 6:
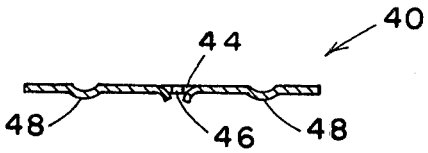
FIG. 6 is an end sectional view of the retainer plate of FIG. 5 taken on line 6—6.
Figure 5:
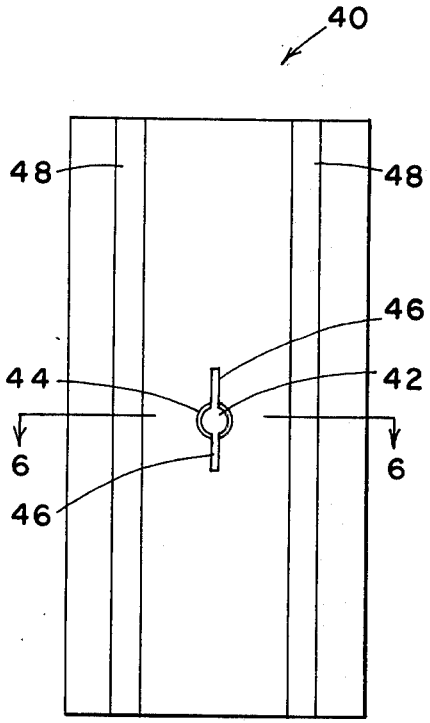
FIG. 5 is a front view of a retainer plate, as embodied in the wall of FIG. 1.

Retainer plate 40, FIGS. 5 and 6, is a flat stiff piece of sheet metal which has a small hole 42 in the center. Hole 42 includes a central circular portion 44 and a pair of narrow vertical slits 46, 46, one of which extends upwardly, and one downwardly from circular portion 44. The central circular portion 44 of hole 42 is of a diameter slightly greater than the height of stem 32, and the width of each slit 46 is slightly less than the width of stem 32. For example, retainer rod 30 may be made from virgin nylon with a head of ⅜ inch (0.9 cm) diameter, 0.050 inch (0.13 cm) thickness with a stem 6½ inch (16 cm) long, 5/32 inch (0.4 cm) in height and 0.050 inch (0.13 cm) in width, with a height at neck 34 of 3/32 inch (0.23 cm), and plate 40 may be 20 gauge sheet steel of 2 inch (5 cm) width, 4 inch (10 cm) height with a hole central portion of 3/16 inch (0.46 cm) diameter and slits 46 of ¼ inch (0.6 cm) length and 0.045 inch to 0.049 inch (0.11 cm to 0.12 cm) width.

The metal of retainer plate 40 adjacent the sides of slits 46 is preferably bent slightly away from plane of wall 10 to provide a slightly sharper edge in the slit 46, to bite into the plastic of stem 32, when plate 40 is affixed to stem 32. Plate 40 is shown as having two vertically extending raised ridges 48, 48, to make plate 40 stiffer.

Figure 7:
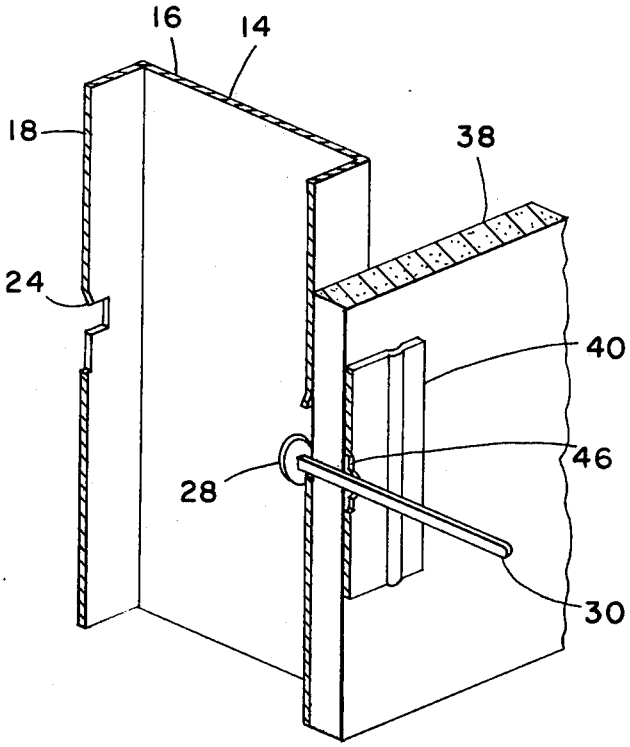
FIG. 7 is an isometric sectional view of the stud, wallboard, retainer rod and retainer plate of FIG. 1, taken on line 7—7.

Referring to FIG. 7, the assembly of stud 14, wallboard 38, retainer rod 30, and retainer plate 40 is shown. This assembly provides a temporary means for holding a wallboard edge portion against the stud 14, for a period of about 24 hours, during which time adhesive, not shown, which is between the stud and the wallboard, sets or dries, developing a strong bond therebetween.

In constructing the assembly, the studs 14, 14 are first put in place, the retainer rods 30, 30 are inserted with heads 28 placed into openings 22, adhesive is placed on the outer surface of face flange 18 or the back surface of wallboard 38, or both, and the wallboard is then placed against the stud, squeezing the adhesive in between. To hold the wallboard in place temporarily, plates 40, 40 are affixed to retainer rods 30, 30. The stem 32 of a retainer rod 30 is inserted through the central circular position 44 of a hole 42 as far as possible and then the stem 32 is forced into one of the slits 46. By the relative dimensions of the stem 32 and the slit 46, the stem 32 is held firmly and prevented from moving relative to plate 40. Plate 40 thus holds wallboards 38, 38 firmly against stud 14.

After the adhesive has had a reasonable period of time to develop increased bond, the plate 40 is removed from stem 32, by moving plate 40 vertically relative to stem 32, to remove the stem 32 from slit 46 to extend through central circular portion 44 of hole 42, whereby the plate 40 is readily removable from stem 32.

Stem 32 is then broken off from head 28, by pulling hard on stem 32, with the break occurring at neck 34.

In applying wallboard to the opposite side of wall 10, the same studs 14, 14, as shown, can be used since there are openings 22, 22 on both face flanges 18, 18. In a preferred form of the invention, additional studs, not shown, constructed similar to studs 14, are added by placing one stud in between each stud used in applying board to the first side. In placing the additional studs, adhesive is applied to both sides of the studs being added, and also to the far side of the studs already in place, so that all studs are adhered to boards on both sides. Only the newly added studs will be adhered most firmly to the wallboard on the far side of wall 10, by the use of retainer rods 30, 30 and plates 40, 40, since the joints between wallboards will be arranged to lie over the newly added studs.

Figure 8:
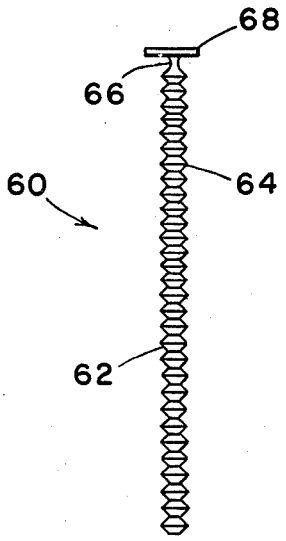
FIG. 8 is a top view of a modified form of retainer rod.

FIG. 8 shows a modified form of retainer rod 60, which has a stem 62 which is circular in cross section and has a plurality of circular ribs 64 disposed along the length of stem 62. Stem 62 has a narrowed neck 66 adjacent the head 68. The ribs 64 provide a means for more positively affixing a retainer plate relative to the stem 62.

Figure 9:
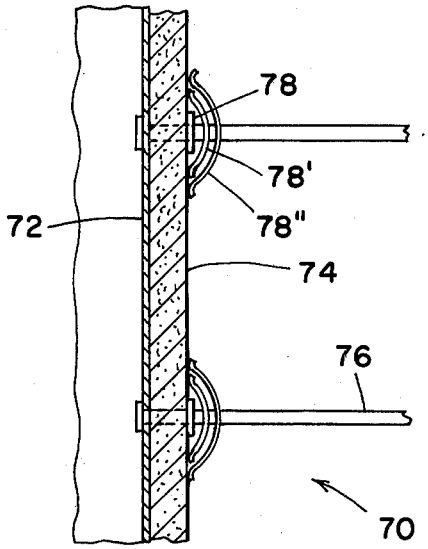
FIG. 9 is a vertical sectional view of a modified form of wall embodying a plurality of retainer plates on each retainer rod.

FIG. 9 shows a wall 70 including a stud 72, wallboard 74 being adhered to stud 72, and retainer rods 76, 76 affixed to stud 72 and extending out through a joint between wallboards 74. A plurality of retainer plates 78, 78', 78'' are affixed to each retainer rod 76. Retainer plates 78, 78', 78'' are of progressively longer length and are shaped to apply pressure to progressively wider apart portions of the wallboard edge.

Figure 10:
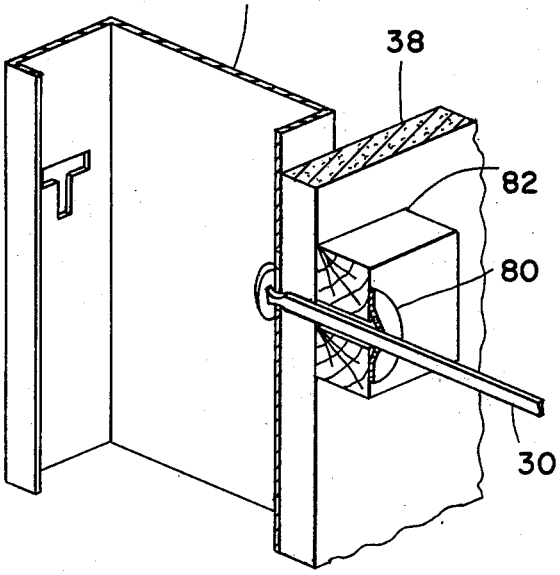
FIG. 10 is an isometric sectional view of a modified form of wall wherein a pressure plate is retained against wallboard by separate means which grasp the retainer rod.

FIG. 10 shows how a small retainer clip 80 may be used in combination with a relatively large block 82, with the clip 80 affixed to a retainer rod 30, and pushing the relatively larger block 82 against the wallboard edge portion, during setting of the adhesive, now shown, between the wallboard 38 and stud 14.

Figure 11:
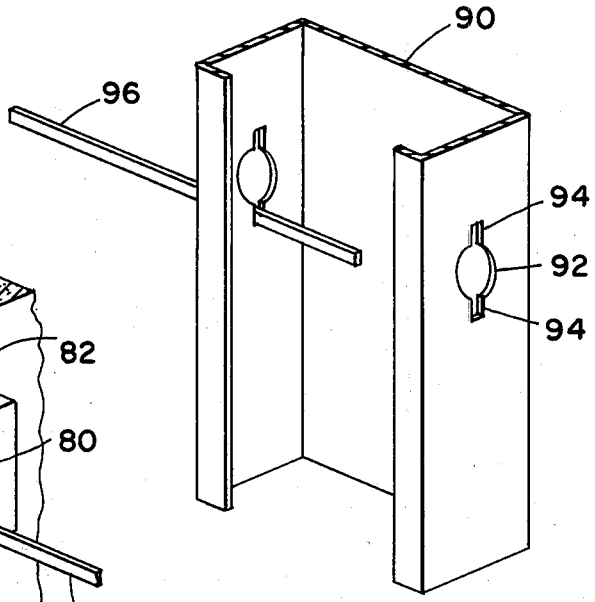
FIG. 11 is an isometric view of a modified form of stud and retainer rod.

FIG. 11 shows a still further modified form of the invention. Stud 90 has openings 92 similar to the hole 42 in plates 40. The openings 92 include vertically extending slits 94, 94, of a size and configuration suitable to grasp a retainer rod 96 which has no head. The rod is grasped in one of the slits 94, 94, by inserting one end of the rod in the opening 92 and pulling it upward or downward into one of the tightly grasping slits 94, 94. After the retaining rod 96 has completed its function, in temporarily holding wallboard during setting of adhesive, the rod is removed from the slit 94 by pulling outward and upward, or outward and downward, depending on whether it is in the lower or the upper slit.

Having completed a detailed disclosure of the preferred embodiments of my invention, so that others may practice the same, I contemplate that variations may be made without departing from the essence of the invention.

I claim:

1. In combination with wallboard being adhered to wallboard supports, a temporary holder for wallboard comprising an elongate rod having one end affixed relative to one of said wallboard supports, said rod extending outward from said support between the abutting edges of two adjacent wallboards, and a retainer plate disposed firmly against the edges of said adjacent wallboards, said retainer plate being urged against said wallboard edges by means engaging said rod, said engaging means comprising at least one slit extending away from an opening, said slit having a width less than the width of the cross section of said rod and said opening being larger than said rod, said rod being grasped by said rod engaging means in a manner preventing relative movement of said rod engaging means away from said wallboard.

2. In the combination of claim 1, a T-shaped opening in said wallboard support, and an enlarged head on said rod engaged in said T-shaped opening, whereby said rod is affixed relative to said support.

3. In the combination of claim 2, a neck of reduced dimension on said rod adjacent said head.

4. In the combination of claim 1, an elongate rod having a plurality of circular ribs disposed along the length thereof for interlocking with an opening in said retainer plate.

5. In the combination of claim 1, a retainer plate having a hole therethrough, said hole having a pair of slits extending one upward from the center of said hole and one downward from the center of said hole, said slits having a width less than the width of the cross section of said rod.

6. In the combination of claim 5, a retainer plate of sheet metal, said metal being bent slightly out of the general plane of said retainer plate at locations adjacent said slits, whereby said rod is held more firmly by the edges of said slits.

7. In combination with wallboard being adhered to wallboard supports, a temporary holder for wallboard comprising an elongate rod having one end affixed relative to one of said wallboard supports, an opening in said wallboard support, said opening including a slit, having a dimension smaller than the cross-sectional width of said rod, said rod being held in said slit by being forced into said slit and being held by said slit, said rod extending outward from said support between the abutting edges of two adjacent wallboards, and a retainer plate disposed firmly against the edges of said adjacent wallboards, said retainer plate being urged against said wallboard edges by means engaging said rod, said engaging means comprising rod engaging edges, said rod engaging edges being spaced apart a distance less than the dimension between the two edges of said rod which are engaged by said rod engaging edges, said rod being grasped by said rod engaging means in a manner preventing relative movement of said rod engaging means away from said wallboard.

8. A wall comprising a plurality of wallboards, means for supporting said wallboard behind the area of the joints between said wallboards, an adhesive between said wallboards and said supporting means, and temporary means for holding said wallboards against said supporting means for a period of time during which said adhesive develops an improved bond strength, said temporary means comprising a removable rod, said removable rod having one end affixed to said supporting means, said rod extending from said supporting means outwardly through the joint between said wallboards and still further outwardly a substantial distance beyond said wallboards, and a retainer plate disposed firmly gainst the face of said wallboard, said retainer plate being held against said wallboard by means which are in engagement with said rod, said means comprising at least one slit extending away from an opening, said slit having a width less than the width of the cross section of said rod and said opening being larger than said rod, said rod being disposed in said slit with said retainer plate disposed against said wallboards, whereby said retainer plate holds said wallboards against said supporting means.

9. A wall as defined in claim 8 wherein a plurality of retainer plates of varying dimensions are affixed to a single rod, whereby pressure is applied to the wallboard face at a plurality of positions.

10. A method of affixing wallboards to wallboard supports, comprising affixing one end of an elongate rod to one of said supports, disposing two wallboards in coplanar relation with abutting edges forming a joint disposed over said support with said elongate rod extending through said joint, and with an adhesive disposed between said support and each of the two wallboard edges, holding said two wallboards temporarily against said supports while said adhesive develops increased bonding strength by placing holding means against the exposed face of each said wallboard, urging said holding means firmly against said exposed face of each said wallboard by engaging said elongate rod in a narrow slit in a retainer plate, which said slit frictionally grasps said rod, and urging said retainer plate against said holding means, and, after said adhesive had developed increased bonding strength, removing said holding means and at least the exposed portion of said elongate rod.

* * * * *